United States Patent [19]

Hackett

[11] 4,367,643

[45] Jan. 11, 1983

[54] METHOD AND APPARATUS FOR COLD FORMING METAL ARTICLES HAVING IRREGULAR CROSS-SECTION

[75] Inventor: Kenneth P. Hackett, Nashville, Tenn.

[73] Assignee: The Gleason Works, Rochester, N.Y.

[21] Appl. No.: 216,956

[22] Filed: Dec. 16, 1980

[51] Int. Cl.[3] ..... B21D 22/00

[52] U.S. Cl. ..... 72/353; 72/399; 72/402

[58] Field of Search ..... 72/352, 353, 358, 399, 72/402

[56] References Cited

U.S. PATENT DOCUMENTS

| | | | |
|---|---|---|---|
| 3,135,139 | 6/1964 | Kralowetz | 72/402 X |
| 3,194,200 | 7/1965 | Brogren | 72/402 |
| 3,263,478 | 8/1966 | Brauer | 72/402 |
| 3,335,598 | 8/1967 | Jessen | 72/402 |
| 3,538,735 | 11/1970 | Zimmerman | 72/402 X |
| 3,566,664 | 3/1971 | Schweizer | 72/402 |
| 3,568,494 | 3/1971 | Geisman | 72/402 |

*Primary Examiner*—Leon Gilden
*Attorney, Agent, or Firm*—Luedeka, Fitch & Neely

[57] ABSTRACT

A method and apparatus are provided for cold forming a metal article having varying lateral cross-sections. A hydraulically operated, longitudinally movable force applying member is adapted to apply force to a slug during formation. A die cavity is defined by a frame defining a central bore and a plurality of channels extending radially from the central bore. The central bore is coaxial with the force applying member. A plurality of die nibs, each having a first end and a second end with the first end being mounted in the central bore, are mounted in the channels. At least one of the nibs being slidably mounted within one of the channels. The second end of the slidable member is inclined and engaged by a cam bar secured to the force applying member. The sliding nib is urged toward the central bore to enclose the die cavity as the force applying member is moved to a force applying position.

8 Claims, 2 Drawing Figures

METHOD AND APPARATUS FOR COLD FORMING METAL ARTICLES HAVING IRREGULAR CROSS-SECTION

The present invention relates to metal forming and particularly to the cold forming of metal into articles which vary in lateral cross-section.

In a typical cold forming operation, a slug is deposited within a solid die nib having a shape and size corresponding to the desired article to be formed. Thereafter, one or more forces are longitudinally applied to the slug to cause the metal to flow and conform its shape to that of the die cavity. The article is then removed from the die cavity by pushing it axially out of the die cavity. The formed article falls into a retrieval area for storage or further processing, such as tumbling, for example. For articles which have surfaces parallel to the central axis, such as cylindrical or tubular articles, such axial removal is quite satisfactory. However, it has more difficult to cold form metals into more complex shapes having concave or undercut surfaces, i.e. articles which vary in lateral cross-section. One of the greater difficulties lies in the removal of the formed article. With an undercut or concave article, the die cavity walls extend into the finished article. In order to remove the article, the die cavity must be enlarged, generally by separating the die. A convex shaped article can pose comparable difficulties.

In the metal-forming field, split dies have been employed to form undercut, concave and convex surfaces. Such separable dies have permitted the die cavity to be at least partially opened to allow insertion of a slug, then closed for forming, then reopened for axial removal of the completed article. However, such split die systems have employed elaborate mechanisms for moving the die sections and failed to permit the use of large forming forces. In most cases the prior systems have produced excessive amounts of scrap which disrupt the machine operation and require frequent maintenance. Moreover, the development of scrap has created an unnecessary expense and limits the class of articles which can be manufactured by cold forming in contrast to machining. That is, high tolerance articles cannot be produced if scrap is developed.

Accordingly, it is an object of the present invention to provide a method and apparatus for cold forming metal into articles having undercut, convex or concave surfaces. It is also an object to provide a method and apparatus for the axial removal of an undercut, convex or concave article from a die cavity defining such a shape. It is a further object to provide an apparatus for defining a die cavity with a plurality of die sections, which cavity does not deform under the substantial forces of cold forming metal. It is a still further object to provide a method and apparatus for cold forming metal which minimizes the amount of scrap produced and permits the cold forming of high tolerance articles.

Further objects and advantages will be apparent when the following description is considered along with the accompanying drawings in which.

Figure 1:
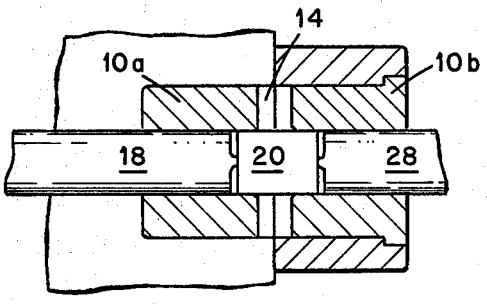
FIG. 1 is a fragmentary top view, partly cutaway and partly in section, of one embodiment of an apparatus embodying various of the features of the invention and showing the apparatus in the closed position.
Figure 2:
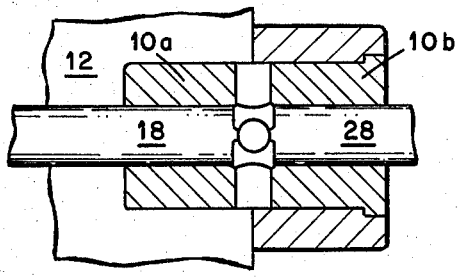
FIG. 2 is a sectional view taken generally along line 2—2 of FIG. 1.
Figure 3:
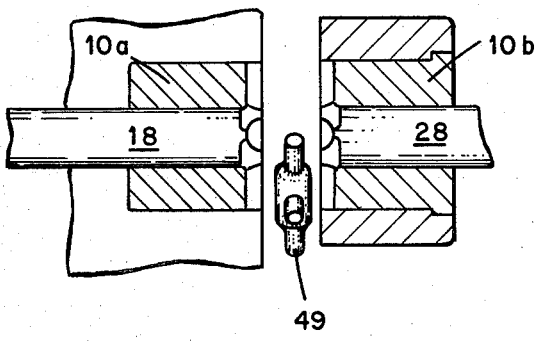
Figure 4:
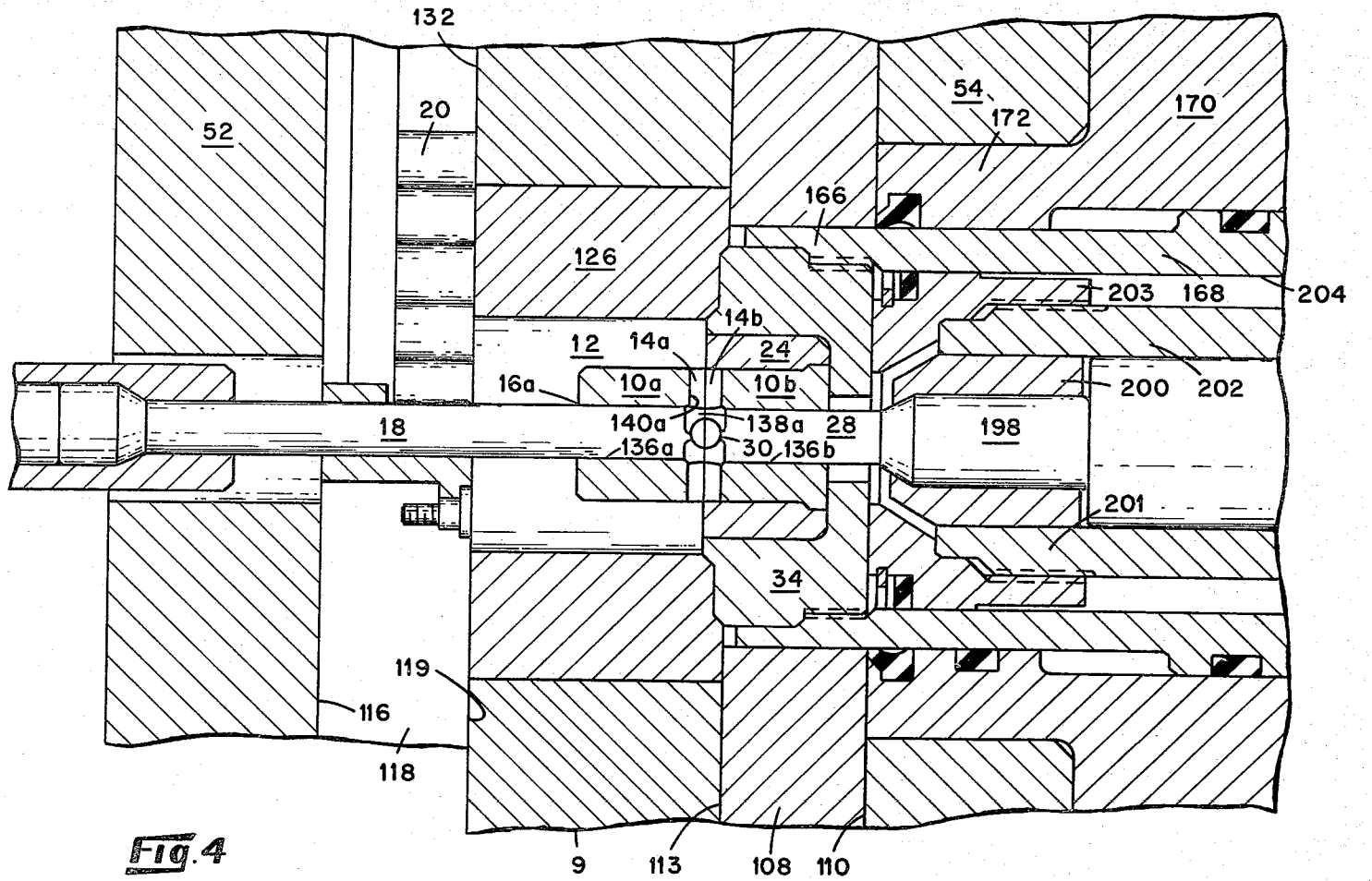

Generally, in accordance with the present invention a die cavity is defined by a plurality of separate die nib members which are arranged radially from a central bore on a holder. At least one of the die nib members is longitudinally movable relative to the holder to open and close the die cavity. The movable die nib is urged to the open position by spring means mounted in the holder and bearing upon the movable nib member. The movable die nib is moved longitudinally to a closed position through engagement by a cam bar directly connected to a movable force applying member, such as a hydraulically powered anvil of the cold forming apparatus and substantially enclosed in a solid plate member. The die nib is peripherally closed prior to the application of axially directed force to the slug by the ram and the anvil.

Referring more specifically to the drawings, the illustrated embodiment of the present invention is adapted for use in conjunction with a hydraulically powered cold forming apparatus as disclosed in U.S. Pat. No. 4,197,757, issued on Apr. 15, 1980, which is incorporated herein by reference.

In accordance with the present invention, a die nib assembly 10 defines a cavity 14 within a first end 16 of which there is reciprocatably disposed a ram 18 which selectively closes the end 16 of the cavity 14. The opening second end 22 of the cavity 14 is selectively closed by a reciprocatable power pad means 24 comprising a sleeve defining an axial bore 26. Within the bore 26 an anvil 29 is reciprocatably disposed. The power pad 24 is provided with an annular shoulder 32 adapted to be received within the end 22 such that the shoulder 32 and the leading end 30 of the anvil 28 cooperatively close the end 22 of the die cavity 14. The power pad 24 and anvil 28 are selectively adjustable longitudinally so that the power pad 24 can be moved into a closed position prior to the time at which the anvil 28 reaches a force-applying position.

The view in FIG. 1 is looking down on the top of the apparatus and shows a plate 54 adapted to be supported on a suitable frame means (not shown). The plate 54, which is oriented in a vertical plane, is provided with a detachable first die stack holder 108 on its face 110. The holder 108 is releasably secured to the face 110 as by bolts, for example. This holder 108 is provided with a recess adapted to receive the die stack 9 as discussed more fully in U.S. Pat. No. 4,197,757. A corresponding die stack holder (not shown) is provided for the opposing side of the die stack 9 to fully secure the die stack 9 in a position coaxial with the ram 18 and the anvil 28.

The die stack 9 includes a support member 31 having an axial bore 33 and a die cavity assembly 35, which are secured to one another as with bolts. The bore 33 defined in the support member 31 is adapted to slidingly receive a cylindrical slug as the ram 18 urges the slug into the die cavity assembly.

The die cavity assembly 35 defines a selectively openable die cavity 37 adapted to open to receive a slug having a constant cross-sectional shape, such as a cylinder, then close to define a cavity having the shape of the desired article, then reopen to release the formed article.

The die cavity assembly 35 comprises a frame member 39 which defines an axial bore 41 having a diameter greater than the diameter of the bore 33 and three elongated channels 43, 45 and 47. The channels 43, 45 and 47 extend radially from the bore 41 and are spaced apart radially at angles of about 120°. A stationary die nib member 49 is secured in the channel 43 by a securing plate 51. The nib member 49 includes a forming section 53 which extends into the bore 41. The nib member 49 is oriented vertically when the die cavity assembly 35 is mounted in the die stack 9 so that when a slug is inserted into the bore 41, it rests upon the forming section 53 of the stationary nib member 49.

An elongated die nib member 55 is slidably mounted within each of the channels 45 and 47. The nib members 55 are essentially identical. Therefore one of the members 55 will be described in detail and it will be understood that the description applies to both nib members 55.

The die nib member 55 comprises a forming section 57 and a bearing section 59. The forming section 57 extends radially outwardly from the central bore 41, where it includes a surface 61 which defines approximately one third of the periphery of the die cavity. The forming section 57 extends outwardly to approximately the midpoint of the channel 47 where the forming section 57 overlaps the bearing section 59 to form a smooth and secure transition. The forming section 57 and bearing section 59 are secured to one another with a bolt 63. The bearing section 59 continues to extend radially and terminates in a bearing surface 65 which is planar and forms an angle of about 5° with the axis of the nib member 55.

An elongated key 67 is formed integral with and extends along each side of the nib member 55. Eack key 67 is slidingly received by a mating groove defined in the channel side wall 69.

A pair of opposing indents 71 are defined in the channel side walls 69 and a matching pair of opposing indents 73 are defined in the bearing section 59. The indents 73 on each side of the nib member 55 and the indents 71 cooperatively define a pair of cavities each of which is adapted to receive a coil spring 75. The spring 75, which is about one inch long and 0.5 inch in outer diameter, bears against a shoulder 77 defined by the indent 73 to urge the die nib member 55 radially outwardly from the central bore 41 to an open position.

When the die nib members 55 are in the open position, a slug is easily inserted into the space defined therebetween. After forming, an article having irregular lateral cross-section is also released for ejection by the movement of the die nib members 55 to the open position.

As noted hereinabove, the die nib members 55 are spring biased to an open position. Means are provided for selectively urging the members 55 radially inwardly to a closed position to define a closed die cavity within the bore 41 for cold forming an article having irregular lateral cross-section from a slug having regular geometry.

In the depicted cold forming apparatus the forming anvil 28 is driven by a fluid cylinder 220. The means for selectively urging the members 55 to a closed position are simultaneously driven by the cylinder 220. A disc-shaped plate member 79 is directly attached to the cylinder 220, extending circumferentially therefrom. Two elongated cam bar retainers 81 are directly attached and extend perpendicularly from the plate member 79, parallel to the longitudinal axis of the anvil 28 and the cylinder 220. A cam bar 83, mounted coaxially on each of the retainers 81, extends slidingly through a retaining sleeve 85 mounted in the plate 54.

Each cam bar 83 is adapted to engage the bearing surface 65 of one of the movable die nib members 55 to urge the nib member 55 to the closed position prior to the time when the anvil 28 reaches a force-applying position. Then, after the article has been formed, the cam bar 83 maintains the die nib member 55 in the closed position for a dwell time at the end of the cycle and then releases the nib member 55, allowing the springs 75 to urge the member 55 radially outwardly to release the formed article for discharging.

The cam bar 83 includes a bearing insert 87 which comprises a hardened material adapted to resist wearing from bearing contact with the bearing surface 65 of the nib member 55.

The exposed bearing surface 89 of the insert 87 is planar and slopes outwardly from the leading edge 91 at an angle of about 5°, thus matching the sloping bearing surface 65 of the nib member 55. The matching angled relation of the bearing surfaces 89 and 65 permits continuous sliding contact between the nib member 55 and the cam bar 83 as the cam bar 83 moves in parallel relation with the anvil 28. The angled relationship also causes the die nib member 55 to move radially inwardly toward the bore 41, perpendicular to the direction of travel of the anvil 28 and cam bar 83.

In operation, the cycle begins with the ram 18 retracted to the left, the anvil 28 retracted to the right and the power pad 24 retracted to the right, as viewed in FIG. 1. The retraction of the anvil 28 to the right causes the cam bars 83 to release the nib members 55. The springs 75 urge the nib members 55 radially outwardly to the open position.

When the apparatus is activated to form an article, the power pad 24 is then moved to the left to the closed position shown in FIG. 1. A slug is placed in the bore 33 in front of the ram 18. The ram 18 pushes the slug through the bore 33 into the bore 41, where it rests upon the surface 61 of the stationary die nib member 49. The anvil 28 is moved to the left by the cylinder 220. As the anvil moves toward the bore 41, the cam bars 83 are simultaneously moved parallel to anvil 28 through the plate 79 and retainer bars 81. The sliding engagement of the cam bars 83 with the die nib members 55 causes the members 55 to move radially inwardly with the channels 45 and 47, closing the circumferential surface of the die cavity 14. The die nib members 55 reach the fully closed position before the anvil reaches a force applying position. Thereafter, additional force is applied to the ram 18 and anvil 28 to cause the inserted slug to flow and fill the enclosed die cavity 14. When the article has been fully formed within the die cavity 14, the anvil 28 and power pad 24 are again retracted to the right to the initial positions. As the anvil 28 retracts, the cam bars 83 are simultaneously retracted, thus releasing the die nib members 55. The springs 75 urge the members 55 radially outwardly to release the formed article 93. The small angle defined by the bearing surfaces 65 and 89 cause the die nib members 55 to be released at a lesser velocity than the velocity at which the anvil is retracted. This velocity difference permits a short period, or dwell time, during which the formed article 93 is maintained in the substantially enclosed die cavity 14. It has been determined that this retention for a short period is sufficient to substantially improve the dimensional stability of the formed articles.

Upon complete opening of the nib members 55, the ram 18 pushes the formed article 93 out of the die cavity 14 for storage or further processing. The ram 18 is then retracted to the left, returning to the original position to begin a new cycle.

Employing s system in accordance with the present invention, the types of movement employed are not complex so that large forming forces can be used. Also, the amount of scrap developed in the cold forming of a concave or undercut article with a split die has been reduced substantially. Consequently, the apparatus requires less maintenance and there is less wastage. Moreover, the tolerances achievable for a cold-formed article has been greaty reduced, thus expanding the range of articles which may be cold formed without further machining.

While a preferred embodiment has been described and shown with particularity herein, it will be recognized that there is no intention to limit the invention by the disclosure, but rather it is intended to cover all modifications and alternate constructions falling within the spirit and scope of the invention as defined in the appended claims.

What is claimed is:

1. An apparatus for defining a die cavity in an apparatus for cold forming a metal slug into an article having irregular lateral cross-section, including a hydraulically operated, longitudinally movable, force applying member adapted to apply force to said slug during formation, said die cavity defining apparatus comprising a frame defining a central bore and a plurality of elongated channels extending generally radially from said central bore, said central bore being located coaxially with said force applying member, a plurality of elongated die nibs, each of said die nibs having a first end and a second end, said first end being mounted within said bore, at least one of said die defining members being slidably mounted within one of said channels, said slidable member including an inclined surface at said second end, cam bar means secured to said force applying member, said cam bar means including a cam surface adapted to engage said inclined surface of said slidable member to urge said sliding member generally radially toward said bore when said force applying member is moved to a force applying position.

2. An apparatus as defined in claim 1 including spring means urging said slidable die defining member radially outwardly from said central bore.

3. An apparatus as defined in claim 1 wherein said cam surface of said cam bar is inclined.

4. An apparatus as defined in claim 1 wherein said inclined surface of said slidable member and said cam surface of said cam bar are inclined at generally equivalent angles of about 5°.

5. An apparatus as defined in claim 1 wherein said longitudinally movable force applying member comprises an anvil.

6. The method of cold forming a metallic billet within a die cavity in a single uninterrupted motion in an apparatus including a first longitudinally movable force applying member and a coaxial opposed second longitudinally movable force applying member, a frame member located between said first and second force applying members and defining a central bore generally coaxial with said first and second force applying members, a plurality of die nib members mounted upon said frame member and extending generally radially from said central bore, at least one of said die defining members being slidably mounted for generally radial movement, comprising the steps of:

hydraulically urging said first force applying member into a position axially adjacent to said die nib members, depositing said billet between said die nib members, hydraulically urging a second force applying member into a position axially adjacent to said die nib members and opposite from said first force applying member, hydraulically urging a third force applying member toward said die nib members to engage said slidable die nib member and generally radially urge said slidable die nib member to a closed position, then continuing to urge said third force applying member into contact with said billet to form an article and complete the enclosure to said die cavity.

7. A method as defined in claim 6 and further comprising retracting said second force applying member prior to retraction of said third force applying member.

8. A method as defined in claim 7 wherein said third force applying member is retracted at a greater velocity than said slidable die nib member is released to an open position whereby a dwell time is provided for said formed article.

* * * * *